United States Patent [19]

Long

[11] 4,356,956

[45] Nov. 2, 1982

[54] COMMERCIAL MULTICOMPARTMENT MAIL MESSAGE UNIT

[76] Inventor: Walter D. Long, 137 DeForest Rd., Dix Hills, N.Y. 11746

[21] Appl. No.: 172,205

[22] Filed: Jul. 25, 1980

[51] Int. Cl.[3] ..... B65D 91/00

[52] U.S. Cl. ..... 232/24; 232/1 R

[58] Field of Search ..... 232/1 R, 24, 25, 17, 232/38, 39

[56] References Cited

U.S. PATENT DOCUMENTS

| | | | |
|---|---|---|---|
| 1,104,153 | 7/1914 | Steward | 232/24 |
| 2,382,092 | 8/1945 | Onos | 232/24 |
| 3,107,848 | 10/1963 | Penta | 232/17 |
| 3,758,026 | 9/1973 | Henderson | 232/1 R |
| 3,836,069 | 9/1974 | Craig, Jr. | 232/1 R |

FOREIGN PATENT DOCUMENTS

| | | | |
|---|---|---|---|
| 772454 | 8/1934 | France | 232/25 |
| 446910 | 3/1949 | Italy | 232/24 |
| 65701 | 9/1913 | Switzerland | 232/24 |

*Primary Examiner*—James T. McCall
*Assistant Examiner*—Peter A. Aschenbrenner
*Attorney, Agent, or Firm*—Richard L. Miller

[57] ABSTRACT

A mail message unit of multi compartment type for commercial use; including an elongated case divided into a row of compartments by partitions therebetween, an individually locked, pivotable front door for each compartment, and an elongated, single top cover hinged in an inclined position across a top of the case; the cover being multi-slotted for placement of mail in any of the compartments, and being transparent so as to allow observation therethrough into the compartments.

1 Claim, 6 Drawing Figures

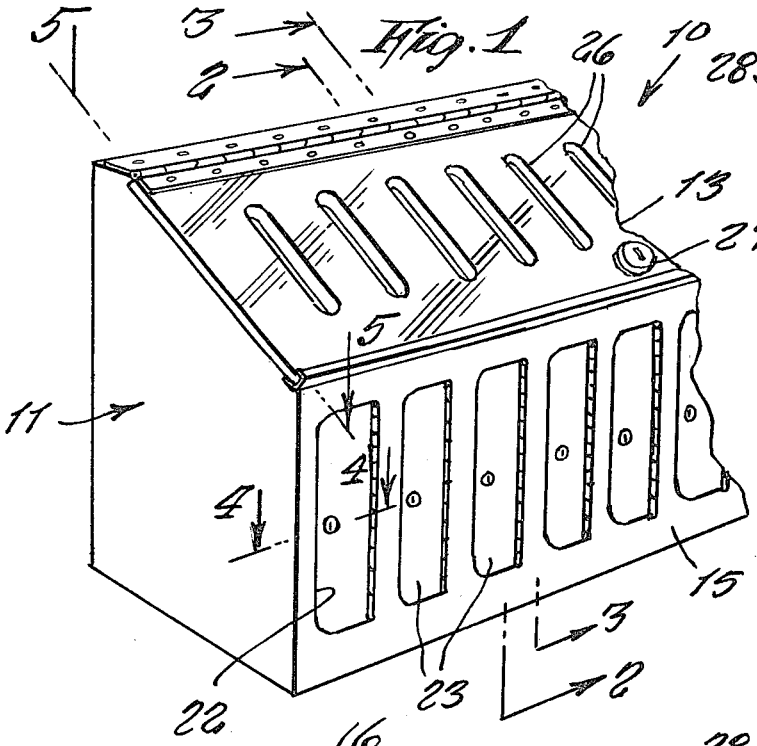
Fig. 1
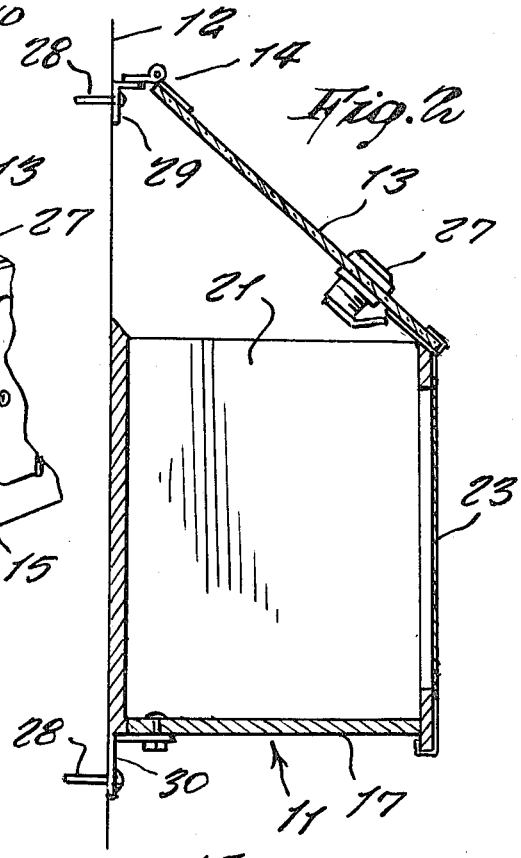
Fig. 2
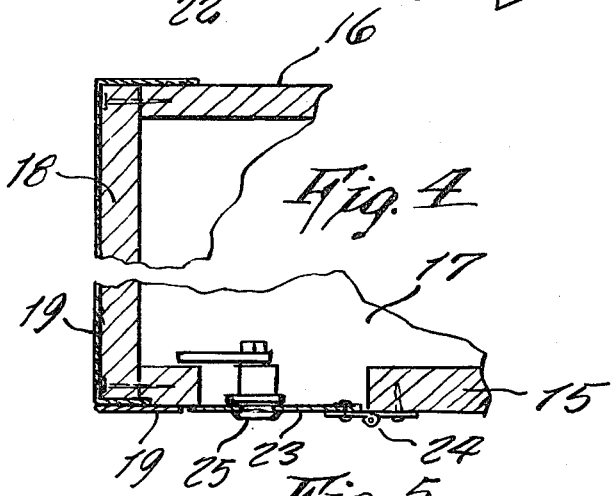
Fig. 4
Fig. 5
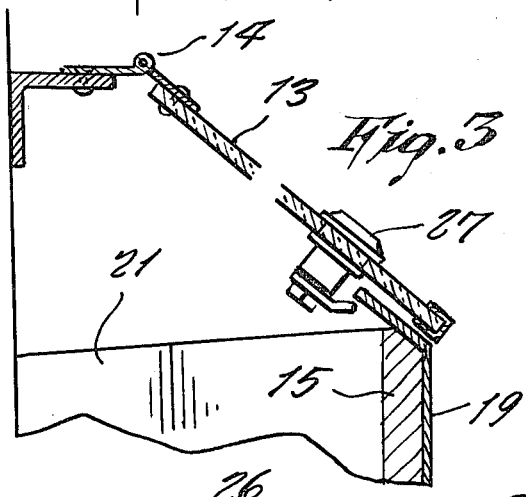
Fig. 3
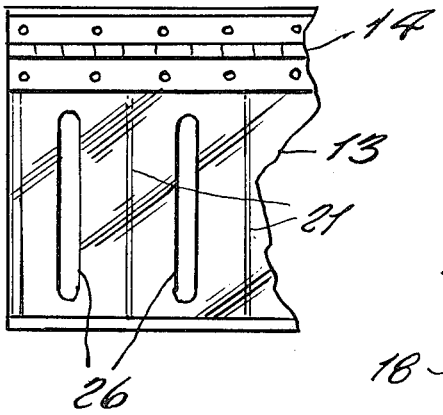
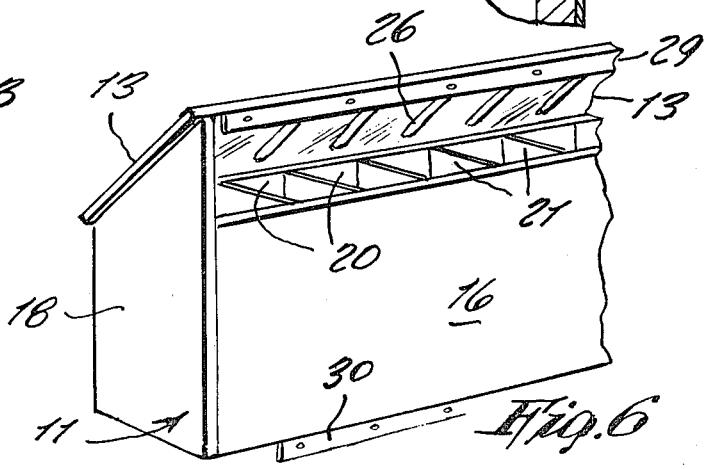
Fig. 6

COMMERCIAL MULTICOMPARTMENT MAIL MESSAGE UNIT

BACKGROUND OF THE INVENTION

It is well known that a large business or industrial establishment requires the transmission of mail, notes and other papers between departments and individual offices or employees. Accordingly mail message stations are provided in most such establishments where such mail may be picked up. Often such stations comprise only a box that may or may not even be sectioned for quick and easy mail pick up, and the box may be flat on top so that larger packages are simply laid on its top, making access difficult into the box, and making sortment of an individual's mail a task. This situation is accordingly in need of an improvement.

SUMMARY OF THE INVENTION

Therefore it is a principal object of the present invention, to provide a mail message unit which is multicompartmented for individual sortment and resultant quick and easy mail pick up, so as to be more efficient by saving time.

Another object is to provide a multi compartment mail message unit which is ideal for large organizations where inter-office mail is necessary, such as large business and industrial establishments.

Yet another object is to provide a multicompartment mail message unit which is transparent on top so as to allow individuals to quickly see if there is any mail in their compartments, each compartment being individually accessible for deposit of mail therein, and each compartment being individually locked for private access only by the holder thereof.

Yet a further object is to provide a multicompartment mail message unit which may be wall-mounted and which is inclined on its top so that large packages may not accumulate upon it and block view of the compartments therein.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a front fragmentary perspective view of the invention.

FIG. 2 is a cross sectional view on line 2—2 of FIG. 1.

FIG. 3 is a cross sectional view on line 3—3 of FIG. 1.

FIG. 4 is a cross sectional view on line 4—4 of FIG. 1.

FIG. 5 is a top section of see thru lexan cover line 5—5.

FIG. 6 is a rear fragmentary perspective view of the invention.

DETAILED DESCRIPTION OF PREFERRED EMBODIMENT

Referring now to the drawing in greater detail, the reference numeral 10 represents a commerical multicompartment mail message unit, according to the present inventon, wherein there is an elongated case 11 mountable against a vertical wall 12, and the case being closable on top by an upwardly pivotable cover 13 mounted on a hinge 14.

The case is comprised of a front wall 15, back wall 16, bottom wall 17, and opposite side walls 18 made of plywood, the outer sides of the front and side walls having a heavy gauge aluminum sheeting 19 bonded thereto. The elongated case is divided into compartments 20 by means of aluminum partitions 21 therebetween. A row of openings 22 through the front wall provide access to each compartment; each opening being fitted with an aluminum door 23, outwardly pivotable on a piano hinge 24. A key-operated lock 25 is installed on each door.

The cover 13 is made of a transparent, one-quarter inch thick clear plastic sheet that permits observation therethrough and into the compartments for purpose of checking the same for presence of mail, without need to open the door 23. The cover is mounted to rest at a forwardly downwardly inclined angle so that no packages may be accumulated thereupon. A row of slots 26 through the cover provide access for deposit of mail or messages into any of the compartments by any person at the unit. A single key-operated lock 27 on the cover permits the cover to be raised by a mailman so as to deliver volume mail into the unit.

As shown in FIG. 3, the upper edge of the partitions may be made rearward downwardly inclined so that an elongated package such as a roll of blueprints may be placed thereacross without view interference, in case of a necessity for a secure delivery only thereof into the unit. It is to be noted that partitions may be made by a manufacturer to be movable for adjusting a compartment size in order to receive packages as well as the mail.

The unit is securable to the wall 12 by means of wall fasteners 28 received through upper and lower angle brackets 29 and 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A commercial multicompartment mail message unit, comprising in combination, an elongated case divided by a plurality of vertical partitions into a row of compartments, and a hinged, transparent cover in an upwardly rearwardly inclined position upon said case; a row of hinged doors on a front of said case, each said door providing access to one said compartment; a row of slots through said cover, each said slot providing access to one compartment located therebelow; opposite side end walls of said case extending upwardly to opposite end edges of said cover so to enclose a space between an upper edge of said partitions and said upwardly inclined cover, said upper edge of said partitions being rearwardly downwardly inclined so to support thereupon an elongated package stored in said space, and allow rearwardly roll or slide of said package; and a rear of said case including means for mounting against a vertical wall; said cover and each said door including key-operated locking means.

* * * * *